United States Patent [19]

Braun et al.

[11] 4,236,550

[45] Dec. 2, 1980

[54] ELASTIC MUSLIN BANDAGE

[75] Inventors: Franz Braun; Ewald Schäfer, both of Wolfstein, Fed. Rep. of Germany

[73] Assignee: Karl Otto Braun KG, Wolfstein, Fed. Rep. of Germany

[21] Appl. No.: 874,158

[22] Filed: Feb. 1, 1978

[30] Foreign Application Priority Data

Feb. 17, 1977 [DE] Fed. Rep. of Germany ..... 2706787

[51] Int. Cl.[3] ..... D03D 15/08

[52] U.S. Cl. ..... 139/421; 128/156

[58] Field of Search ..... 139/420 R, 421, 422, 139/426 R; 128/169, 155, 156

[56] References Cited

U.S. PATENT DOCUMENTS

| | | | |
|---|---|---|---|
| 3,221,736 | 12/1965 | Heitzmann | 139/421 |
| 3,409,008 | 11/1968 | Mortensen et al. | 139/421 |
| 3,523,528 | 8/1970 | Patience et al. | 128/156 |
| 3,920,054 | 11/1975 | Goff et al. | 139/421 |
| 3,943,981 | 3/1976 | DeBrabander | 139/421 |
| 3,965,944 | 6/1976 | Goff et al. | 139/421 |

FOREIGN PATENT DOCUMENTS

| | | | |
|---|---|---|---|
| 192864 | 11/1957 | Austria | 139/421 |

*Primary Examiner*—Henry Jaudon

*Attorney, Agent, or Firm*—Toren, McGeady and Stanger

[57] ABSTRACT

The invention relates to an elastic muslin bandage with in part elastic and non-elastic threads and with non-elastic weft threads which can be used elastically and as a fixing dressing having a high elastic behavior, permits an easy application to conical extremities and joints, is conductive to moisture and heat so that no moisture and heat chambers form, and in which slipping of the individual bandage layers is prevented, whereby the bandage is constructed in such a way that in the warp the web has textured polyfilic polyamide threads of thickness Td 70/13/2 or a lighter or heavier titre varying therefrom as the elastic element and threads of 17 tex staple fibre and/or bleached cotton of size Nm 60 or the like as the rigid element in a ratio 1:1, 1:2, 1:3, 2:1, 2:2, 2:3, 2:4 or the like, and in the case of a ratio of 1:1 in a number of 59 textured polyfilic polyamide fibres and 58 staple fibres based on the web width of 10 cm, and in the weft threads of 17 tex bleached cotton and/or staple fibre or a blended yarn of cotton/staple fibre of size Nm 60 or the like in a number of 68 threads per 10 cm and/or in the case of a ratio of 1:2, 39 textured polyfilic polyamide fibres and 78 staple fibres and/or bleached cotton fibres or blended yarn filaments of cotton/staple fibre and/or in the case of a ratio of 1:3, 29 textured polyfilic polyamide fibres and 88 staple fibre and/or bleached cotton threads or blended yarn filaments of cotton/staple fibre based on a web width of 10 cm.

18 Claims, 6 Drawing Figures

ELASTIC MUSLIN BANDAGE

Figure 1:
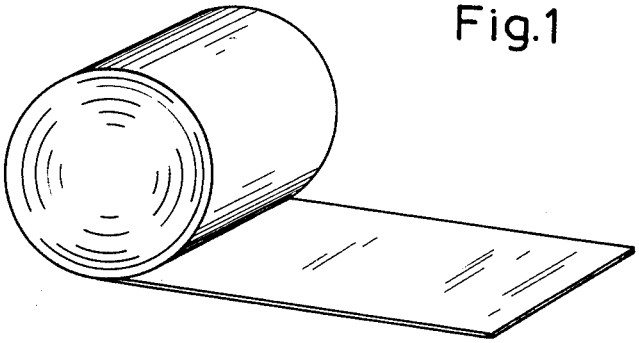

The invention relates to an elastic muslin bandage with in part elastic and non-elastic threads and with non-elastic weft threads.

Elastic muslin bandages whose elasticity results from elastic warp threads of crimped polyamide are known. The advantage of such bandages is that they have a relatively good elastic behaviour. However, the use of crimped polyamide fibres as the elastic element leads to the important disadvantage that in the case of a considerable number of patients allergies can be caused by the "crimped loops" of the polyfilic polyamide fibres. This is largely due to the fact that the elastic polyamide fibres completely cover the bleached cotton or staple fibre weft so that the latter can no longer fulfil its function of taking up moisture and heat and absorption.

In addition the rigid muslin bandage of DIN 61,631 is known which is made from bleached cotton or cotton and staple fibre. Such bandages have a high absorptivity, do not lead to allergies, and are generally found pleasant to wear by the patient. However, due to the fact that the bandage is rigid there is no possibility as in the case of the previously described elastic muslin bandage of flexibly applying the same to conical parts of the body and joints and therefore it inhibits movement. As a result the individual turns of the bandage will obviously slip.

The problem of the invention is to provide an elastic muslin bandage which is elastic and can be used as a fixing band, which has a high elastic behaviour, permits easy application to conical extremities and joints, is conductive to moisture and heat so that no moisture and "heat-chambers" are formed and in connection with which it is not possible for the individual layers of the bandage to slip.

According to the invention, this problem is solved by an elastic muslin bandage comprising a web with in part elastic and non-elastic threads and with non-elastic weft threads, characterised in that in the warp the web has (a) textured polyfilic polyamide fibres of thickness Td 70/13/2 or (b) a lighter titre differing therefrom or (c) a heavier titre as the elastic element and threads of 17 tex staple fibre and/or bleached cotton with the size Nm 60 or the like as the rigid element in a ratio of 1:1, 1:2, 1:3, 2:1, 2:2, 2:3, 2:4 or the like and in a ratio of 1:1 in a number of 59 textured polyfilic polyamide fibres and 58 staple fibres based on the web width of 10 cm and/or in a ratio of 1:2, 39 textured polyfilic polyamide fibres and 78 staple fibre and/or bleached cotton threads and in the weft threads of (d) 17 tex bleached cotton and/or staple fibre or (e) a blended yarn of cotton/staple fibre with size Nm 60 or the like with the same warp setting corresponding to 1 (*c*) or (f) blended yarn filaments of cotton/staple fibre and/or at a ratio of 1:3, 29 textured polyfilic polyamide fibres and 88 staple fibre and/or bleached cotton fibres or blended yarn filaments of cotton/staple fibre, based on a web width of 10 cm.

The invention also relates to an elastic muslin bandage comprising a web with in part elastic and non-elastic threads and with non-elastic weft threads, characterised in that in the warp the web has (a) finely spun polyurethane fibres of size 45/80/120/160 dtex or the like or (b) finely spun rubber fibres with the size 120/136, 100/112, 90/100 or the like with spinning from single or double yarns and/or twisted threads and with a Z twisting direction or an S twisting direction and with a Z and an S twisting direction as the elastic element and threads of (c) 17 tex staple fibre and/or bleached cotton or (d) blended yarns of cotton/staple fibre with the size Nm 60 or the like as the rigid element in a ratio of 1:1, 1:2, 1:3 or the like and with a ratio of 1:1 in a number of 59 finely spun polyurethane and/or rubber fibres and 58 staple fibre and/or bleached cotton threads or (e) a blended yarn of cotton/staple fibre, based on a web width of 10 cm and in a ratio of 1:1 threads and in the weft (f) 17 tex bleached cotton and/or staple fibre or (g) a blended yarn of cotton/staple fibre with the size Nm 60 or the like in a number of 58 threads per 10 cm.

A muslin bandage formed in this way has an extensibility of approximately 150% which can be increased or decreased by increasing or decreasing the number of weft threads and the yarn count, whereby it is also dependent on the contractile force of the textured polyamide fibre. As a result of this high elastic behaviour it can be easily applied to conical extremities and joints. In addition the bandage has a high conductivity for moisture and heat so that no moisture and "heat-chambers" can form. Due to the high staple fibre proportion in the warp it also has a high absorptivity. Due to the special honeycomb structure of the bandage it is not possible for the individual layers thereof to slip and as a result the bandage can be applied to conical parts of the body and joints. The bandage also has a very high permeability to air due to the high pore volume. As a result of the special construction of the bandage only the staple fibre and/or cotton threads or blended yarn filaments which are compatible with the skin and absorb secretion project from the surface.

According to a further development of the invention, in the weft the web has threads of 17 tex staple fibre. It is also possible for the warp of the web to have textured polyamide and/or spun polyurethane or rubber fibres and cotton threads.

The invention also relates to a development according to which in the warp the web has textured polyfilic polyamide and/or spun polyurethane or rubber fibres and elastic spun crepe threads of size Nm 34/1, Nm 40/1, Nm 50/1, Nm 60/1, Nm 70/1 and the like of cotton or staple fibre or fine elastic twisted crepe threads of size Nm 60/2, Nm 70/2, Nm 100/2, Nm 140/2 and the like of cotton or staple fibre with an S and/or Z twisting direction. Due to the use of elastic spun crepe threads or crepe twisted threads in the warp of the web the elastic behaviour of the bandage is considerably improved. As a result of the crepe threads or the twisted crepe threads the bandage attains a much greater resistance to slipping because there is a better hooking together of the individual turns of the bandage. Furthermore, a very voluminous dressing is obtained which has a high pore volume. The spun crepe threads are twisted to a greater extent than normal and it is particularly advantageous if the warp of the web comprises a recurrent sequence of a textured polyamide fibre, a spun crepe thread with an S twisting direction, a textured polyamide fibre and a spun crepe thread with a Z twisting direction, or the recurrent sequence of a textured polyamide fibre, two spun crepe threads with an S twisting direction, a textured polyamide fibre and two spun crepe threads with a Z twisting direction.

As a result of the construction of the elastic muslin bandage according to the invention the staple fibre and/or cotton threads which are absorptive and compatible with the skin are pressed to the surface by the internal elastic polyamide or polyurethane and/or rubber fibres so that the dressing has good compatibility with the skin.

In addition, the invention relates to a development of the elastic muslin bandage in which the web has only crepe threads or crepe twisted threads in the warp.

The invention also relates to a muslin bandage which is longitudinally transversely elastic, has a high pore volume and can be readily adaptedly applied to very curved parts of the body. Such a muslin bandage is constructed in such a way that the warp of the web has the same warp structure as the previously described longitudinally elastic muslin bandages, whereas the weft comprises crepe yarns or crepe twisted threads with S twisting direction and Z twisting direction or textured polyamide fibres and/or finely spun polyurethane fibres.

In the system of yarn size used herein, the following symbols are to be understood to have the designations indicated as follows:

tex=grams per kilometer
Nm=kilometers per kilogram
Td=grams per 9,000 meters
dtex=grams per 10,000 meters.

Figure 2:
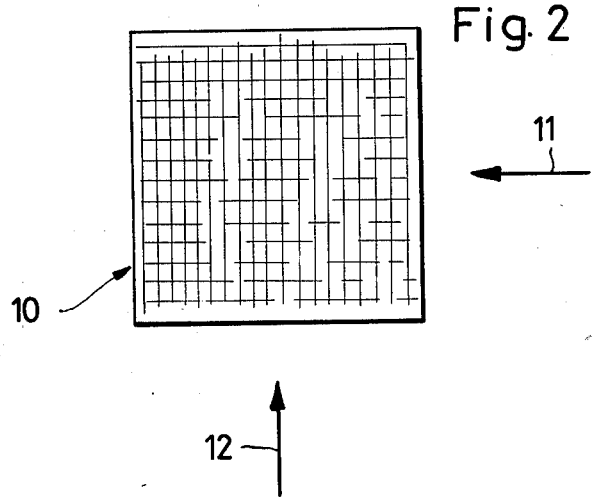
Figure 3:
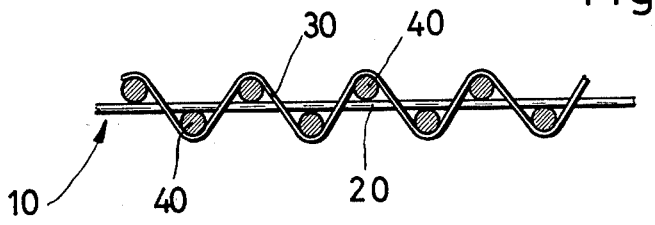
Figure 4:
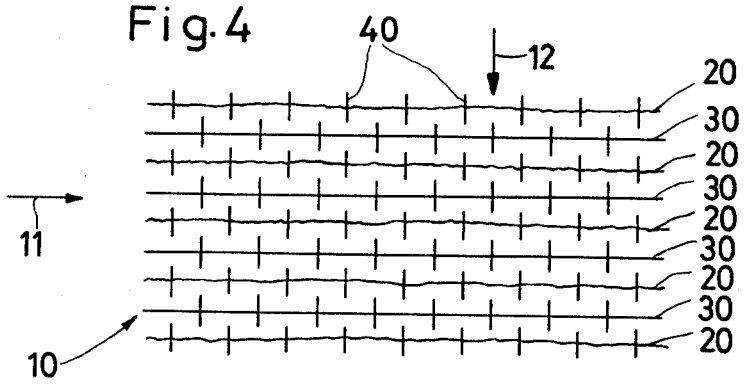
Figure 5:
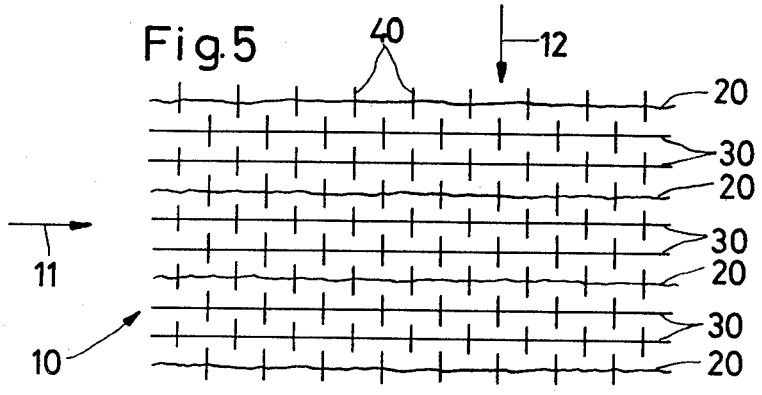
Figure 6:
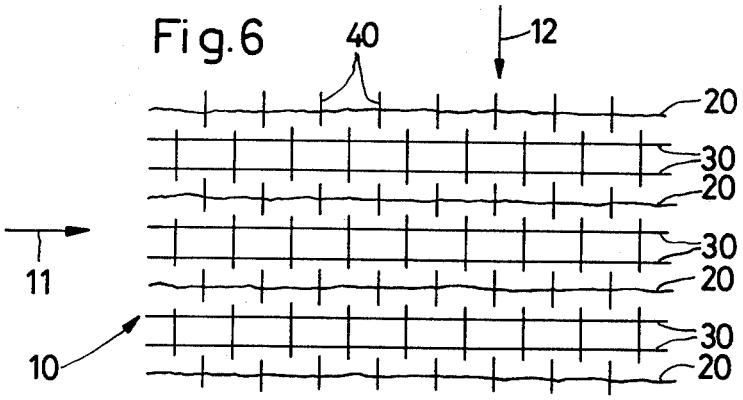

An exemplified embodiment of the invention is described hereinafter relative to the drawings wherein show:

FIG. 1 a rolled up elastic muslin bandage in diagrammatic form;

FIG. 2, a plan view of the web comprising the warp and weft;

FIG. 3, a section along the weft threads;

FIG. 4, a plan view of the web with a thread ratio of 1:1 and having a basket weave;

FIG. 5, a plan view of the web of FIG. 4 but with a thread ratio of 1:2;

FIG. 6, a plan view of the web with a thread ratio of 1:2 with a rep-like weave.

The web of the muslin bandage constructed according to the invention is given the reference numeral 10 in FIG. 2 and comprises warp and weft threads. The direction of the warp threads is shown by arrow 11 and that of the weft threads by arrow 12.

According to one embodiment of the invention web 10 has in warp 11 as the elastic element textured polyfilic polyamide fibres 20 of thickness Td 70/13/2 and as the rigid element threads 30 of 17 tex staple fibre and/or bleached cotton of size Nm 60. The ratio of said two threads 20, 30 is 1:1. In the case of a ratio of 1:1 there are 59 textured polyfilic polyamide fibres 20 and 58 staple fibre threads 30 over a width of 10 cm. The weft 12 of web 10 is formed from threads 40 of 17 tex bleached cotton and/or staple fibre and/or cotton/staple fibre with size Nm 60. The number of weft threads is 68/10 cm (FIG. 3).

As can be gathered from FIG. 3 the staple fibre and/or bleached cotton yarns which are compatible with the skin project from the surface, whereas the yarns which are in part not compatible with the skin remain on the inside.

As can be seen in FIG. 4 web 10 has a basket weave.

The polyfilic textured polyamide fibres 20 of titre or thickness 70/13/2 can be replaced by lighter and heavier titres with different capillary thread numbers. Furthermore, heavier and finer yarns e.g. of Nm 40, Nm 50, Nm 70, Nm 80 and the like can be used in warp 11 in place of threads 30 of 17 tex staple fibre. It is also possible to use bleached cotton yarns and blended yarns of cotton and staple fibre in the above-mentioned thicknesses. Twisted threads with the same end number and made from the same material can also be employed.

In weft 12 threads 40 of 17 tex cotton which must be bleached and absorptive can be replaced by threads of 17 tex staple fibre and/or cotton and staple fibre. It is also possible to use finer and heavier yarns and/or twisted threads with the same end number and of the same material. The extensibility can be increased or decreased by increasing or decreasing the weft number. The ratio of warp threads 20 and 30, i.e. the ratio of elastic to rigid elements can be 1:1, 1:2, 1:3 and the like, whereby the thread density can vary for the same ratio. The thread ratio can also be 2:1, 2:2, 2:3, 2:4 etc.

Furthermore, according to another embodiment of the invention it is possible to use finely spun polyurethane and/or rubber fibres in place of the textured polyfilic polyamide fibres 20 or other textured polyfilic synthetic fibres in warp 11. Core yarn filaments as well as covered polyurethane and/or latex fibres can also be used. The number of said polyurethane fibres can be 45, 80, 110, 160 dtex and the like and that of the rubber fibres 120/136, 100/112, 90/100 and the like. Spinning can take place from single or double yarns and/or twisted threads of bleached cotton or staple fibre. It is also possible to use textured polyfilic polyamide threads and/or other polyfilic synthetic threads. Spinning can take place in a clockwise or anticlockwise direction as well as in both directions. The ratio of the warp threads together with the remaining data, sizes etc. can be the same as indicated hereinbefore.

For the purpose of improving the elastic behaviour of the bandage the threads 30 of web 10 can comprise elastic spun crepe threads of size Nm 34/1, Nm 40/1, Nm 50/1, Nm 60/1, Nm 70/1 and the like of cotton or staple fibre. Finer elastic twisted crepe threads of size 60/2, Nm 70/2, Nm 100/2, Nm 140/2 and the like of cotton and staple fibre can also be used in combination. These crepe threads are twisted to a greater degree than normal. It is particularly advantageous in this connection if a spun crepe thread of Z twisting direction follows a spun crepe thread of S twisting direction. A web constructed in this way then consists in the warp of the recurrent sequence of a textured polyfilic polyamide fibre 20, a spun crepe thread 30 with S twisting direction, a textured polyfilic polyamide fibre 20 and a spun crepe thread 30 with Z twisting direction (FIG. 4). However, it is also possible to form the web 10 in such a way that the warp comprises the recurrent sequence of a textured polyfilic polyamide fibre 20, two spun crepe threads 30 with S twisting direction, a textured polyfilic polyamide fibre 20 and two spun crepe threads 30 with Z twisting direction. However, in all cases the sum of all the twisting moments of the crepe threads must be 0.

Therefore with a web 10 according to the invention the following possible variations occur in warp 11:

I. A textured polyfilic polyamide fibre 20 and a staple fibre or cotton thread 30 as the normal yarn or as a spun crepe or twisted crepe thread, whereby the ratio can be 1:1, 1:2, 1:3 and the like;

II. a spun polyurethane or rubber fibre 20 and a staple fibre or cotton thread 30 as the normal yarn or as the spun crepe or twisted crepe thread, whereby the ratio can be 1:1, 1:2, 1:3;

III. a core yarn thread with cotton and/or a core twisted thread 20 and a staple fibre or cotton thread 30 as the normal yarn or as the spun crepe or twisted crepe thread, whereby the ratio can be 1:1, 1:2, 1:3.

Thus, in the case of I, II and III for the same ratio the density can increase or decrease to a greater or lesser extent.

In cases I and II web 10 contains in the weft 12 threads 40 of staple fibre or cotton and/or staple fibre and cotton.

As can be gathered from FIG. 3, the staple fibre or cotton threads 40 are pressed to the surface by the spun crepe or twisted crepe threads 20 so that the web has a honeycomb structure. Thread 20 can also be a spun rubber and/or a polyurethane fibre.

In addition to a basket weave according to FIGS. 4 and 5 the web can also have a rep weave according to FIG. 6.

Whereas the elastic muslin bandage according to the above-described embodiments has elastic elements such as e.g. textured polyamide spun rubber, core yarn threads, core twisted threads combined with rigid yarn elements or staple fibre, cotton or cotton/staple fibre and/or cotton crepe threads and/or cotton crepe twisted threads, it is also possible to produce elastic muslin bandages whose warp comprises solely crepe twisted threads and/or solely spun crepe threads, whereby there are thread sequences of threads with S and Z twisting directions, the sum of the twisting moments of all the crepe threads being equal to 0.

According to a further embodiment of the invention, it is also possible to produce elastic muslin bandages in which only crepe threads and/or crepe twisted threads are used in the warp 11. Each crepe thread with an S twisting direction of number 60 is followed by a crepe thread with the same number and a Z twisting direction. In addition two crepe threads with the S twisting direction can be followed by two crepe threads with the Z twisting direction. However, it is vital that the sum of all the twisting moments of the different crepe threads is equal to 0. Finally, it is also possible to use finer and thicker crepe yarns.

According to another embodiment of the invention, it is also possible to produce elastic muslin bandages in which crepe yarns and/or twisted yarns are combined with normal yarns in the ratio 1:1, 1:2, 1:3 etc., whereby as is required for crepe yarns and/or twisted yarns one S thread is followed by one Z thread or two S threads are followed by two Z threads and the like. The dimensions of the crepe yarns and/or twisted yarns correspond to those given hereinbefore, the same applying regarding the dimensions of the normal yarns and/or twisted yarns.

According to a further embodiment of the invention, it is possible to produce a longitudinal transverse elastic muslin bandage having a high pore volume and which can be readily and flexibly applied to highly curved parts of the body. In the warp direction the structure of such a bandage is identical with the previously described embodiment for longitudinal elastic muslin bandages. In warp 11 a spun crepe thread with the S twisting direction is followed by such a thread with the Z twisting direction and/or two spun crepe threads with the S twisting direction are followed by two such threads with the Z twisting direction, whereby the spun crepe threads are of number 60. However, it is also possible to use finer and coarser numbers for the spun crepe threads in warp 11. In addition, a longitudinal transverse elastic bandage can be produced which has the same warp structure as the longitudinal elastic bandage described hereinbefore, whilst the weft comprises crepe yarns or crepe twisted yarns with the S and Z twisting directions or textured polyamide fibres and/or fine spun polyurethane fibres.

The weft material is formed by crepe yarns with S and Z twisting directions, as well as crepe twisted yarns with S and Z twisting directions which can be arranged in the same way as the warp threads, i.e. a spun crepe thread with the S twisting direction is followed by a spun crepe thread with the Z twisting direction and/or two spun crepe threads with the S twisting direction are followed by two such threads with the Z twisting direction. The number of such yarns and/or twisted yarns is also approximately Nm 60. However, finer and coarser crepe threads can also be used. It is obviously also possible to use warp variations in the same way as was described for longitudinal elastic muslin bandages. It is thus possible to obtain elastic muslin bandages in the form of longitudinal transverse elastic fixing dressings with easy and flexible application. Textured polyfilic polyamide and/or similar synthetic fibres or finely spun polyurethane and/or rubber fibres can also be used as elastic elements for obtaining the transverse elasticity.

We claim:

1. In an elastic muslin bandage consisting of warp threads and weft threads, the improvement comprising that said warp threads consist essentially of first threads and second threads, that said first threads consist essentially of elastic fibers, that said second threads consist essentially of non-elastic fibers and that said weft threads consist essentially of non-elastic fibers, said warp threads being arranged with said first and second threads in a recurrent sequence in accordance with the following:

(a) first threads consisting of at least one of textured polyfilic polyamide fiber, spun polyurethane fiber and rubber fiber;

(b) second threads consisting of at least one of a spun crepe fiber having an S-twisting direction and a size Nm 34/1, Nm 40/1, Nm 50/1, Nm 60/1, Nm 70/1, and a fine elastic twisted crepe fiber of size Nm 60/2, Nm 70/2, Nm 100/2, Nm 140/2, said spun crepe fiber and said fine elastic twisted crepe fiber consisting of at least one of the fibers cotton or cellulose;

(c) first threads consisting of at least one of textured polyfilic polyamide fiber, spun polyurethane fiber and rubber fiber;

(d) second threads consisting of a twisted crepe fiber having a Z-twisting direction.

2. A bandage according to claim 1 wherein said elastic fibers of said first threads are weaved in said bandage with said non-elastic fibers of both said second threads and said weft threads so that said non-elastic fibers of said second threads and said weft threads extend externally about said elastic fibers of said first threads.

3. A bandage according to claim 1 wherein said weft threads of non-elastic fibers consist of 17 tex cellulose fiber.

4. A bandage according to claims 1 or 3 wherein said first threads of said warp threads consist of at least one of the fibers core yarn fibers, core twist fibers, spun polyurethane fiber and latex fiber.

5. A bandage according to claim 1 wherein said weft threads include at least one of the fibers crepe fiber or crepe twisted fiber.

6. In an elastic muslin bandage consisting of warp threads and weft threads, the improvement comprising that said warp threads consist essentially of first threads and second threads, that said first threads consist essentially of elastic fibers, that said second threads consist essentially on non-elastic fibers and that said weft threads consist essentially of non-elastic fibers, said warp threads being arranged with said first and said second threads in a recurrent sequence in accordance with the following:

(a) a first thread consisting of at least one of a textured polyfilic polyamide fiber, a spun polyurethane fiber and a rubber fiber;

(b) a second thread consisting of at least one of two twisted crepe threads with an S-twisting direction of a size Nm 34/1, Nm 40/1, Nm 50/1, Nm 60/1, Nm 70/1, and a fine elastic twisted crepe thread of a size Nm 60/2, Nm 70/2, Nm 100/2, Nm 140/2, said two twisted crepe threads and said fine elastic twisted crepe thread including at least one of the fibers cotton or cellulose;

(c) a first thread consisting of at least one of the fibers textured polyfilic polyamide fiber, spun polyurethane fiber and rubber fiber;

(d) a second thread consisting of two twisted crepe threads with a Z-twisting direction.

7. In an elastic muslin bandage consisting of warp threads and weft threads, the improvement comprising that said warp threads consist essentially of first threads and second threads, that said first threads consist essentially of elastic fibers, that said second threads consist essentially on non-elastic fibers and that said weft threads consist essentially of non-elastic fibers, said second threads of said warp threads consisting of at least one of the fibers crepe fiber, crepe twisted fiber, and spun crepe fiber, said second threads having a thread sequence with an S-twisting direction and a Z-twisting direction wherein the sum of the torsional moments of all of said threads is zero.

8. In an elastic muslin bandage consisting of warp threads and weft threads, the improvement comprising that said warp threads consist essentially of first threads and second threads, that said first threads consist essentially of elastic fibers, that said second threads consist essentially of non-elastic fibers and that said weft threads consist essentially of non-elastic fibers, said second threads of said warp threads being arranged in a thread sequence as follows:

(a) a second thread consisting of at least one of the fibers one crepe fiber and two crepe fiber with an S-twisting direction and a number 60;

(b) a second thread consisting of at least one of the fibers crepe fiber and two crepe fibers with a Z-twisting direction of the number 60.

9. In an elastic muslin bandage consisting of warp threads and weft threads, the improvement comprising that said warp threads consist essentially of first threads and second threads, that said first threads consist essentially of elastic fibers, that said second threads consist essentially of non-elastic fibers and that said weft threads consist essentially of non-elastic fibers, said second threads of said warp threads being arranged in a sequence in accordance with the following:

(a) a second thread consisting of one of a single crepe fiber and a double crepe fiber with an S-twisting direction of the number 60; and (b) a second thread consisting of at least one of a single crepe fiber and a double crepe fiber with a Z-twisting direction said weft having a thread sequence in accordance with the following:

(c) a weft thread consisting of at least one of a single twisted crepe fiber and a double twisted crepe fiber having an S-twisting direction of the number 60;

(d) a weft thread consisting of a double twisted crepe fiber with a Z-twisting direction of the number 60.

10. In an elastic muslin bandage consisting of warp threads and weft threads, the improvement comprising that said warp threads consist essentially of first threads and second threads, that said first threads consist essentially of elastic fibers, that said second threads consist essentially of non-elastic fibers and that said weft threads consist essentially on non-elastic fibers, wherein said warp threads have a construction corresponding to a longitudinally elastic bandage and wherein said weft threads consist of at least one of the fibers crepe fiber and twisted crepe fiber consisting of at least one of the twisting directions S-twisting direction and Z-twisting direction, and textured polyamide fiber and fine spun polyurethane fiber.

11. In an elastic muslin bandage consisting of warp threads and weft threads, the improvement comprising that said warp threads consist essentially of first threads and second threads, that said first threads consist essentially of elastic fibers, that said second threads consist essentially of non-elastic fibers and that said weft threads consist essentially of non-elastic fibers, wherein said second threads of said warp threads consist of at least one of the fibers crepe fibers, and crepe twisted fibers combined with normal fibers in a ratio 1:1, 1:2, 1:3, etc., and wherein said second threads are arranged in one of the recurrent sequences of an S-twisted thread and a Z-twisted thread and two S-twisted threads and two Z-twisted threads.

12. In an elastic muslin bandage consisting of warp threads and weft threads, the improvement comprising that said warp threads consist essentially of (a) at least one of textured polyfilic synthetic threads, spun covered lisle polyurethane threads and spun covered lisle rubber threads;

(b) at least one of elastic twisted crepe threads having a size Nm 34/1, Nm 40/1, Nm 50/1, Nm 60/1, Nm 70/1, consisting of at least one of cotton, cellulose, and cotton/cellulose and fine elastic twisted crepe thread of size Nm 60/2, Nm 70/2, Nm 100/2, Nm 140/2, consisting of at least one of cotton, cellulose and cotton/cellulose having at least one of the S-twisting and Z-twisting directions;

(c) said weft threads consisting of at least one of crepe yarns, twisted crepe yarns consisting of at least one of the twisting directions S-twisting direction and Z-twisting direction, textured synthetic threads, fine spun covered lisle polyurethane threads and fine spun covered lisle rubber threads.

13. A bandage according to claim 12, wherein said warp threads are arranged in a recurrent sequence in accordance with the following:

(a) at least one of fine textured polyfilic synthetic thread, spun covered lisle polyurethane thread and spun covered lisle rubber thread;

(b) at least one of spun crepe thread with a Z-twisting direction of the size Nm 34/1, Nm 40/1, Nm 50/1, Nm 60/1, Nm 70/1 consisting of at least one of cotton, cellulose and cotton/cellulose and fine, elastic twisted crepe thread of the size Nm 60/2, Nm 70/2, Nm 100/2, Nm 140/2 consisting of at least one of cotton, cellulose and cotton/cellulose;

(c) at least one of textured synthetic thread, spun covered lisle polyurethane thread and spun covered lisle rubber thread;

(d) at least one of spun crepe thread with an S-twisting direction and twisted crepe thread with an S-twisting direction.

14. A bandage according to claim 12 wherein said warp threads are arranged in a recurrent sequence in accordance with the following:

(a) at least one of textured polyfilic synthetic thread, spun covered lisle polyurethane thread and spun covered lisle rubber thread;

(b) at least one of two spun crepe threads with an S-twisting direction of the size Nm 34/1, Nm 40/1, Nm 50/1, Nm 60/1, Nm 70/1 of at least one of cellulose and cotton/cellulose, and fine elastic twisted crepe thread of the size Nm 60/2, Nm 70/2, Nm 100/2, Nm 140/2 of at least one of cotton, cellulose and cotton/cellulose;

(c) at least one of textured polyfilic synthetic thread, spun covered lisle polyurethane thread and spun covered lisle rubber thread;

(d) at least one of two spun crepe threads with a Z-twisting direction and two twisted crepe threads with a Z-twisting direction;

(e) wherein the ratio between the textured polyfilic synthetic thread, the spun polyurethane thread, the spun rubber thread and the spun and twisted crepe threads in the S and Z twisting directions is 1:3.

15. A bandage according to claim 12 wherein said warp threads are arranged in a recurrent sequence in accordance with the following:

(a) at least one of a spun crepe thread with a Z-twisting direction of the size Nm 34/1, Nm 40/1, Nm 50/1, Nm 60/1, Nm 70/1 of at least one of cotton, cellulose and cotton/cellulose, and a fine elastic twisted crepe thread of the size Nm 60/2, Nm 70/2, Nm 100/2, Nm 140/2 of at least one of cotton, cellulose and cotton/cellulose;

(b) at least one of a spun crepe thread with an S-twisting direction and a twisted crepe thread with an S-twisting direction, wherein the spun crepe threads and the twisted crepe threads are arranged in such a manner that a thread with an S-twisting direction is followed by a thread with a Z-twisting direction or two threads with an S-twisting direction are followed by two threads with a Z-twisting direction, so that the torsional moments cancel each other.

16. A bandage according to claim 12 wherein said warp threads are arranged in a recurrent sequence in accordance with the following:

(a) at least one of a spun crepe thread with a Z-twisting direction of the size Nm 34/1, Nm 40/1, Nm 50/1, Nm 60/1, Nm 70/1 of at least one of cotton , cellulose and cotton/cellulose, and a fine elastic twisted crepe thread of the size Nm 60/2, Nm 70/2, Nm 100/2, Nm 140/2 of at least one of cotton, cellulose and cotton/cellulose;

(b) a rigid thread of at least one of cotton, cellulose and cotton/cellulose of the size 17 tex (Nm 60) in a ratio sequence of 1:1, 1:2, 1:3;

(c) at least one of a spun crepe thread with an S-twisting direction and a twisted crepe thread with an S-twisting direction;

(d) a rigid thread of at least one of cotton, cellulose and cotton/cellulose of the dimension 17 tex (Nm 60) in a ratio sequence of 1:1, 1:2, 1:3, wherein (e) said spun crepe threads and twisted crepe threads are arranged in such a manner that a thread with an S-twisting direction is followed by a thread with a Z-twisting direction or two threads with an S-twisting direction are followed by two threads with a Z-twisting direction so that the torsional moments cancel each other.

17. A bandage according to claim 12 wherein (a) the warp of said bandage has a construction which corresponds to the longitudinally elastic bandage;

(b) the weft consists of normally twisted yarns, of at least one of crepe yarns, crepe twisted yarns with an S-twisting direction and a Z-twisting direction, textured polyfilic synthetic threads, fine spun covered lisle polyurethane threads and fine spun covered lisle rubber threads;

(c) wherein the spun crepe threads and the twisted crepe threads are arranged in such a manner that a thread with an S-twisting direction is followed by a thread with a Z-twisting direction or two threads with an S-twisting direction are followed by two threads with a Z-twisting direction, so that the torsional moments cancel each other.

18. A bandage according to claim 12 wherein the elastic elements of the warp threads of spun crepe threads or twisted crepe threads combined with normal threads are in a ratio 1:1, 1:2 etc., and the elastic elements are arranged in one of the recurrent sequences of a thread with an S-twisting direction and a thread with a Z-twisting direction or two threads with an S-twisting direction and two threads with a Z-twisting direction.

* * * * *